US010443582B2

(12) United States Patent
Viard

(10) Patent No.: US 10,443,582 B2
(45) Date of Patent: Oct. 15, 2019

(54) DISTRIBUTION CASING DEVICE FOR A HYDRAULIC MACHINE

(71) Applicant: Poclain Hydraulics Industrie, Verberie (FR)

(72) Inventor: Julien Viard, Compiegne (FR)

(73) Assignee: POCLAIN HYDRAULICS INDUSTRIE, Verberie (FR)

( * ) Notice: Subject to any disclaimer, the term of this patent is extended or adjusted under 35 U.S.C. 154(b) by 661 days.

(21) Appl. No.: 14/813,340

(22) Filed: Jul. 30, 2015

(65) Prior Publication Data

US 2016/0032908 A1 Feb. 4, 2016

(30) Foreign Application Priority Data

Jul. 31, 2014 (FR) ..... 14 57456

(51) Int. Cl.

| | |
|---|---|
| ***F04B 1/04*** | (2006.01) |
| ***F04B 1/047*** | (2006.01) |
| ***F04B 53/16*** | (2006.01) |
| ***F03C 1/34*** | (2006.01) |
| ***F03C 1/047*** | (2006.01) |

(52) U.S. Cl.

CPC ..... *F04B 1/0421* (2013.01); *F03C 1/047* (2013.01); *F03C 1/0435* (2013.01); *F04B 1/047* (2013.01); *F04B 1/0439* (2013.01); *F04B 1/0452* (2013.01); *F04B 53/16* (2013.01)

(58) Field of Classification Search

CPC .... F04B 1/0421; F04B 1/0439; F04B 1/0452; F04B 1/047; F04B 53/16; F03C 1/0435; F03C 1/047; F03C 1/04; F03C 1/0403; F03C 1/0438; F03C 1/0441; F03C 1/045

USPC ..... 91/491, 503; 417/491

See application file for complete search history.

(56) References Cited

U.S. PATENT DOCUMENTS

| | | | | |
|---|---|---|---|---|
| 5,186,094 A * | 2/1993 | Allart | F03C 1/045 91/491 |
| 6,443,047 B1 | 9/2002 | Cunningham | |
| 6,494,126 B1 | 12/2002 | Leinonen | |

FOREIGN PATENT DOCUMENTS

| | | |
|---|---|---|
| FR | 2764947 A1 | 12/1998 |
| WO | WO 2013/160145 A2 | 10/2013 |

OTHER PUBLICATIONS

European Search Report dated Dec. 18, 2014 from corresponding FR Patent Application No. FR1457456, 2 pages.

* cited by examiner

*Primary Examiner* — Kenneth J Hansen
*Assistant Examiner* — Chirag Jariwala
(74) *Attorney, Agent, or Firm* — The Webb Law Firm

(57) ABSTRACT

The device comprises a casing portion that has an open axial end and that has two main holes, respectively for fluid feed and for fluid discharge. Said holes open out in an inside axial face of the casing portion, respectively via a first main orifice and via a second main orifice that are disposed in succession in the direction going away from the open axial end. The inside axial face has first, second, and third sealing inside bearing surface arrangements, respectively situated between the open axial end and the first main orifice, between the two main orifices, and beyond the second main orifice. At least two of the three arrangements are staggered inside arrangements, each of which comprises two axial bearing surfaces that are staggered relative to each other, and that are separated by a shoulder facing towards the open axial end.

17 Claims, 5 Drawing Sheets

DISTRIBUTION CASING DEVICE FOR A HYDRAULIC MACHINE

CROSS-REFERENCE TO RELATED APPLICATIONS

This application claims priority under 35 U.S.C. § 119 to French Patent Application No. FR 1457456, filed Jul. 31, 2014, the entirety of which is incorporated by reference herein.

The present invention relates to a distribution casing device for a hydraulic machine, said distribution casing device comprising a casing portion that has an open axial end and that has two main holes, respectively for fluid feed and for fluid discharge, said holes opening out in an inside axial face of the casing portion, respectively via a first main orifice and via a second main orifice, which orifices are disposed in succession in the direction going axially away from the open axial end, the inside axial face having first, second, and third sealing inside bearing surface arrangements, respectively situated between the open axial end and the first main orifice, between the two main orifices, and beyond the second main orifice relative to the open axial end.

The hydraulic machine may be a hydraulic motor or a pump. Conventionally, the distribution casing device co-operates with an internal distributor that itself co-operates with a cylinder block. Thus, the internal distributor includes distribution ducts that convey the feed or discharge fluid to and from cylinder ducts of the cylinder block. The internal distributor is disposed inside the distribution casing and has an outside axial face that co-operates with the inside axial face of the distribution casing device, and a radial distribution face that is situated in the vicinity of the open axial end of said casing. The radial distribution face of the internal distributor thrusts against a communication face, which is also a radial face, of the cylinder block, in such a manner that the orifices of the distribution ducts that are situated in the distribution face communicate in alternation with the orifices of the cylinder ducts that are situated in the communication face of the cylinder block.

The internal distributor thus acts as an interface between the main orifices of the feed and discharge holes that are situated in the inside axial face of the distribution casing and the communication face of the cylinder block. For that purpose, the outside axial face of the internal distributor is provided with two main grooves, each of which is in communication with a respective one of the main holes in the inside axial face of the distribution casing, and each of the distribution ducts is connected to one or the other of said grooves.

The hydraulic machine can be of the type having a single active operating cylinder capacity, and the structure of the internal distributor can then be relatively simple, one half of the distribution ducts being connected permanently to one of the main grooves, while the other half are connected permanently to the other groove, and in the distribution face, the successive distribution orifices belong either to one half or to the other half.

However, the hydraulic machine can also be of the type having two operating cylinder capacities, and the internal distributor can then be equipped with a cylinder capacity selector that, depending on its position, puts some distribution ducts into contact with one of the main grooves or with the other of the main grooves.

While the cylinder block and the internal distributor are rotating relative to each other, the orifices of the distribution ducts that are situated in the distribution face of the internal distributor find themselves successively facing a communication orifice of the cylinder block (to feed it with fluid or to receive discharge fluid coming from said orifice) and facing uninterrupted portions of the communication face. When the orifice of a distribution duct is facing an uninterrupted portion, and due to the fluid pressure prevailing in said orifice, a reaction force is generated against said uninterrupted portion that tends to move the communication face of the cylinder block away from the distribution face of the internal distributor. However, for the distribution of fluid to take place correctly, it is important for the distribution face to be thrust against the communication face.

Thus, it is necessary to balance the forces by causing the above-mentioned reaction forces that tend to cause the internal distributor to move away from the cylinder block to be compensated for by opposing forces that tend to cause the internal distributor to approach the cylinder block.

In order to generate such an approach force, it is possible to use devices of the compression spring type that thrust against an end wall of the distribution casing that is opposite from its open axial end, and that urge the internal distributor back towards said open axial end. In practice, such springs are effective only on starting the hydraulic machine, because it would be almost impossible to dimension them such that they can deliver the desired forces over the entire range of feed and discharge pressures used while the machine is operating. For this reason, it is known that provision can be made for the approach forces to use fluid pressures, which requires the interface between the distribution casing and the distributor, in particular as regards the main orifices in the inside axial face of the casing and the main grooves in the outside axial face of the distributor, to have shapes suitable for providing the hydraulic fluid with thrust surfaces that are substantially radial for the hydraulic fluid.

As indicated above, the internal fluid distributor can be of various types, in particular depending on whether the machine has one or two active operating cylinder capacities. Therefore, in order to enable the desired approach forces to be generated by action from the fluid pressure at the interface between the internal distributor and the distribution casing, it is necessary for the inside axial face of the distribution casing to match the outside axial face of the internal distributor exactly.

In practice, this requires as many types of distribution casing devices to be available as there are internal fluid distributors. Those constraints have a negative industrial impact because they make it necessary to design a broad range of distribution casing devices without making it possible to use a common production tool, and therefore without making it possible for them to be mass produced.

An object of the invention is to remedy that drawback by proposing a distribution casing device that is more easily usable for various types of internal fluid distributor, while also offering the possibility of generating appropriate fluid balancing forces.

This object is achieved by the fact that at least two of the three sealing inside bearing surface arrangements are staggered inside arrangements, each of which comprises two axial bearing surfaces that are staggered relative to each other, and that are separated by a shoulder facing towards the open axial end.

Thus, whether or not the shoulders of the staggered axial bearing surfaces are used to participate in the hydraulic balancing depends on which type of internal distributor is associated with the distribution casing device.

Conventionally, when the machine is of the type having a single operating cylinder capacity, the hydraulic balancing can take place merely by shaping the main distribution grooves of the internal distributor, that shaping matching the shaping of the main orifices present in the inside axial face of the distribution casing.

Conversely, for a machine having two operating cylinder capacities, i.e. for a machine that has two sub-motors that, in the full cylinder capacity, are both active, whereas, in the smaller cylinder capacity, only one of the sub-motors is active, the shoulders of the staggered axial bearing surfaces can be used to balance the hydraulic forces concerning the sub-motors that are not directly connected to the main orifices, as explained below.

In accordance with an option, the first and second sealing inside bearing surface arrangements are staggered inside arrangements.

In accordance with an option, at least one of the axial bearing surfaces of each staggered inside arrangement has an annular groove, suitable for receiving a sealing gasket.

The presence of gaskets is necessary between the inside axial face of the casing portion and the outside axial face of the internal distributor in order to guarantee sealed co-operation between these faces, thereby limiting the leaks out of the link between the grooves and the orifices between which the fluid flows. Conventionally, the gaskets are disposed in the grooves that are provided in one or the other of said inside and outside axial faces. It is advantageous to provide certain gaskets on the inside face of the casing portion, ready to receive particular types of internal distributor.

In particular, when the internal distributor is adapted for a machine having a single cylinder capacity, if the staggered arrangements are not used for hydraulic balancing, the grooves present in the axial bearing surfaces of the staggered inside arrangements suffice to provide the sealing, without it being necessary, in addition, to provide grooves with sealing gaskets in the outside axial face of the distributor.

Conversely, if a groove is provided in only one of the axial bearing surfaces of each staggered arrangement and if an internal distributor of the type having two operating cylinder capacities is used, thus requiring sealing on each of the axial bearing surfaces, it is possible to make provision for the internal distributor to have a groove receiving a gasket for co-operating with the axial bearing surface of the corresponding staggered inside arrangement that does not include a gasket.

In accordance with an option, the casing portion is also provided with a secondary hole that opens out in the inside axial face via a secondary orifice situated beyond the second main orifice relative to the open axial end, and the third sealing inside bearing surface arrangement has two axial bearing surfaces situated at the same diameter on either side of the secondary orifice.

It is then possible to make provision for at least one of the axial bearing surfaces of each staggered inside arrangement to have an annular groove, suitable for receiving a sealing gasket.

As explained below, the secondary hole may serve in particular to control a cylinder capacity selector.

The sealing gasket provided on one of the axial bearing surfaces of the third sealing inside bearing surface arrangement serves to provide sealing for the link between the casing portion and the internal distributor on the side opposite from the open axial end of the casing portion. Depending on the situation, the secondary hole may be unused, in particular when the internal distributor is of the type having a single cylinder capacity, it then being possible for a single sealing gasket on the third sealing inside bearing surface to suffice. Conversely, if the secondary hole is used to convey fluid, it is then necessary to provide a gasket co-operating with each of the two axial bearing surfaces of the third sealing inside bearing surface arrangement. By forming this axial bearing surface at the same diameter, provision is made so that it does not offer any fluid thrust surface that disturbs the balancing by the fluid pressures. In this way, the balancing is achieved merely by the radial portions of the surfaces that are subjected to the fluid pressures, i.e. by the shapes of the main orifices and of the main grooves, and by the shapes of the shoulders of the staggered axial bearing surfaces.

The invention also provides a distribution assembly for a hydraulic machine, said distribution assembly including a casing device of the invention as described above, optionally in accordance with the various above-mentioned options, and an internal distributor, disposed in the casing portion in such a manner that a radial distribution face of the distributor is situated in the vicinity of the open axial end of the casing portion and in such a manner that an outside axial face of the distributor faces the inside axial face of the casing portion, said outside axial face having first and second main grooves facing respective ones of the first and second main orifices, and first, second, and third sealing outside bearing surface arrangements, suitable for co-operating with respective ones of the first, second, and third sealing inside bearing surfaces, the internal distributor having distribution ducts that open out in the radial distribution face and that are configured to be connected to one or the other of the main grooves.

As indicated above, depending on whether the internal distributor is of the type having a single cylinder capacity or two cylinder capacities, the fluid pressure balancing can take place by means of the fluid thrust exerted on the radial portions of the surfaces of the main grooves of the outside axial face of the internal distributor, or, in complementary manner, on the shoulders of the staggered inside arrangements provided on the inside axial face of the casing portion with regard to corresponding shoulders situated on the outside axial face of the distributor.

In accordance with an option, each sealing outside bearing surface arrangement comprises a single axial bearing surface.

This applies in particular when the internal distributor is of the type having a single cylinder capacity.

In accordance with another option, at least one of the sealing outside bearing surface arrangements is a staggered outside arrangement that is suitable for co-operating with one of the staggered inside arrangements and that comprises two staggered axial bearing surfaces that are staggered relative to each other and that are separated by a shoulder facing in the direction opposite from the direction in which the distribution face faces; the distributor has an axial bore having first, second, and third selection orifices that are disposed in axial succession, and each of them is connected to a group of distribution ducts, one of the selection orifices being connected to the staggered outside arrangement; and a selection slide is mounted to move in the bore between a position in which the first and second selection orifices are interconnected without being connected to the third selection orifice, and a second position in which the second and third selection orifices are interconnected without being connected to the first selection orifice.

The internal fluid distributor is then of the type having a plurality of operating cylinder capacities, the cylinder capacity being selected by the selection slide. The shoulders of the axial bearing surfaces of the staggered arrangements are then used to contribute to achieving the desired balancing.

It is possible to make provision for the selection slide to have a single selection groove that, when the slide is in the first position, interconnects the first and second selection orifices and that, when the slide is in the second position, interconnects the second and third selection orifices.

The shape of the selection slide is then extremely simple.

In accordance with yet another option, at least two of the sealing outside bearing surface arrangements are staggered outside arrangements, each of which is suitable for co-operating with a respective one of the staggered inside arrangements, each staggered outside arrangement comprising two axial bearing surfaces that are staggered relative to each other and that are separated by a shoulder facing in the direction opposite from the direction in which the distribution face faces; the distributor has an axial bore that has first, second, third, and fourth selection orifices that are disposed in axial succession, and each of which is connected to a respective group of distribution ducts, two selection orifices from among the four selection orifices being connected to respective ones of the two staggered outside arrangements; and a selection slide is mounted to move in the bore between a first position in which the selection orifices are interconnected in pairs and a second position in which three of the selection orifices are interconnected, without being connected to the remaining selection orifice.

The internal distributor then also makes two distinct operating cylinder capacities possible, by using four selection orifices.

It is then possible to make provision for the two selection orifices, which are connected to respective ones of the two staggered outside arrangements, to be two selection orifices that are not interconnected via the selection slide, when said slide is in its first position.

It is also possible to make provision for the selection slide to include a link that, when the slide is in the second position, interconnects two selection orifices, and a selector that, when the slide is in said second position, connects said link to that one of the other two selection orifices that is at the lower pressure, the remaining one of said selection orifices thus being the one that is at the higher pressure.

The selection slide may have two selection grooves that, when the slide is in the first position, respectively interconnect the first and second selection orifices, and the third and fourth selection orifices, whereas, when the slide is in the second position, one of said grooves interconnects the second and third selection orifices.

The invention can be well understood and its advantages appear more clearly on reading the following detailed description of an embodiment shown by way of non-limiting example. The description refers to the accompanying drawings, in which.

Figure 1:
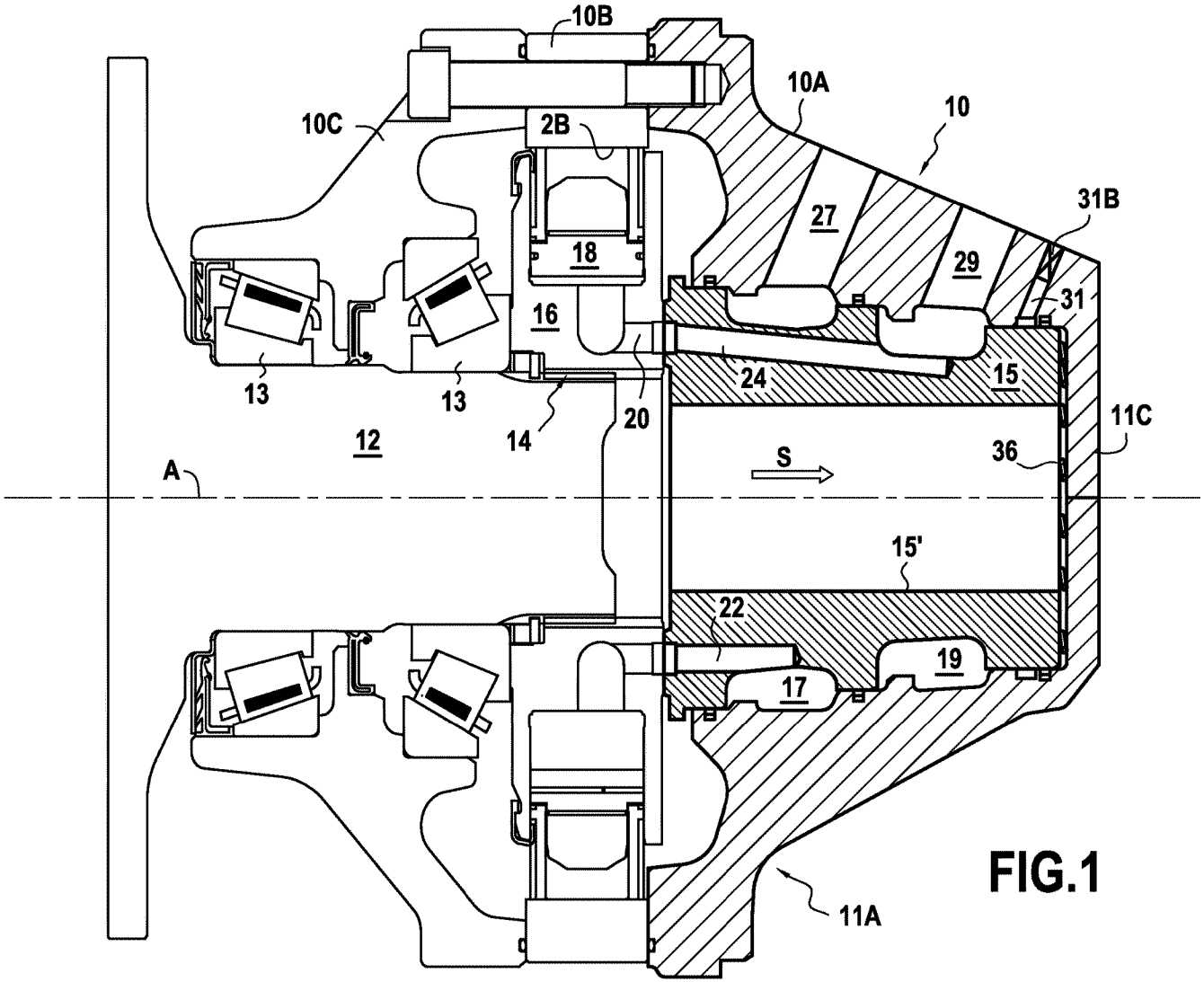
FIG. 1 is an axial section view of a hydraulic machine with a distribution casing device of the invention, receiving an internal distributor of a first type.

Firstly, FIG. 1, which shows a hydraulic machine, in particular a hydraulic motor, is described. However, it should be understood that the invention also applies to other types of hydraulic machine, and in particular to hydraulic pumps.

In a manner known per se, the motor of FIG. 1 has a casing 10 in three portions, respectively 10A, 10B, and 10C. The first portion 10A of the casing is the distribution casing device. The second portion 10B carries an undulating cam 2B on its inside periphery. The third portion 10C serves, in this example, to house the outlet shaft 12 of the hydraulic motor, rotatably holding said shaft via bearings 13. The outlet shaft co-operates, in particular via fluting 14 or the like, with the inside periphery of a cylinder block 16 disposed in the portion 10B of the casing. Thus, the cylinder block 16 and the shaft 12 rotate together relative to the casing 10 about an axis of rotation A.

In a manner known per se, the cylinder block has a plurality of radial cylinders 18 in which pistons are disposed that co-operate with the cam 2B. The cylinder block has cylinder ducts 20 that put the cylinders 18 into communication with the communication face 16A of the cylinder block.

The internal distributor 15, which is constrained not move in rotation relative to the casing portion 10A, has distribution ducts having their orifices opening out in a distribution face 15A of the internal distributor that is situated at the open axial end 11A of the casing portion 10A.

The distribution ducts are put into communication either with a fluid feed or with a fluid discharge. Their orifices that open out in the distribution face 15A are organized, relative to the orifices of the cylinder ducts situated in the communication face of the cylinder block, in such a manner that, while the cylinder block and the casing are moving in rotation relative to each other, the cylinder ducts are put into communication in alternation with the feed and with the discharge.

Figure 1A:
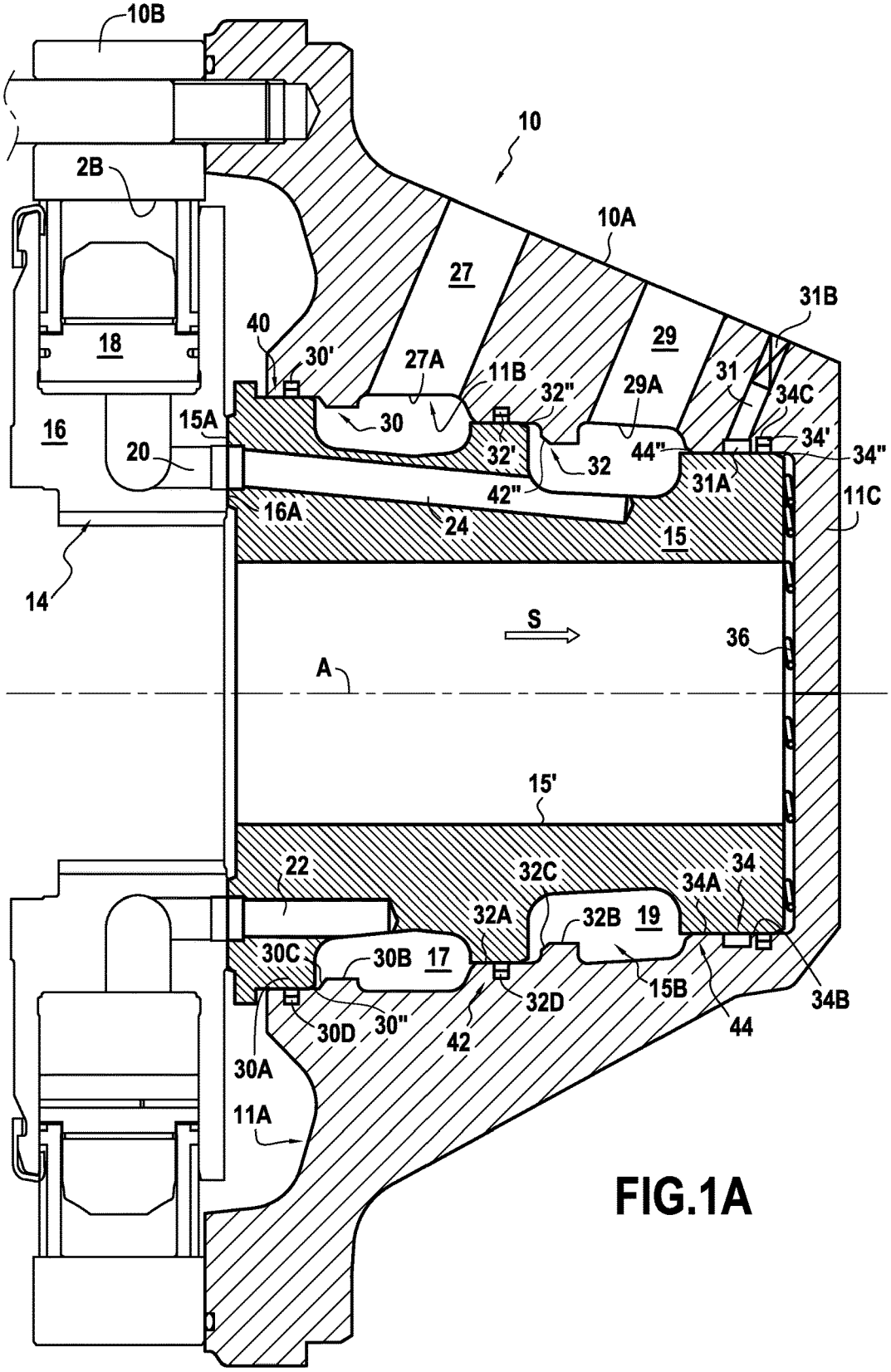
FIG. 1A is a fragmentary view taken of FIG. 1 and in which the distribution casing device is enlarged.

FIGS. 1 and 1A show two distribution ducts, respectively a first distribution duct 22 connected to a first main groove 17 in the outside axial face 15B of the distributor 15, and a second distribution duct 24 connected to a second main groove 19 in the outside face 15B.

The casing portion 10A has two main holes, respectively 27 and 29 that communicate with respective ones of the above-mentioned grooves 17 and 19. More precisely, these holes open out in the inside axial face 11B of the casing 10A, respectively via a first main orifice 27A and via a second main orifice 29A. As can be seen, these two main orifices are disposed in succession in the direction S going away from the open end 11A of the casing portion 10A.

It should be noted that, in this example, the casing portion 10A is bell-shaped, with an end wall 11C opposite from its open axial end 11A. In this example, said casing portion 10A is made in one piece, by casting and/or machining. Naturally, the casing portion 10A could be made in two pieces, i.e. a first piece that is open axially through from one end to the other, and a lid forming the end wall opposite from the open axial end, and mounted on said first piece.

It should be noted that the inside axial face 11B has a first sealing inside bearing surface arrangement 30, a second sealing inside bearing surface arrangement 32, and a third sealing inside bearing surface arrangement 34. The first arrangement 30 is situated between the open axial end 11A and the first main orifice 27A, the second arrangement is situated between the two main orifices 27A and 29A, and the third arrangement is situated beyond the second orifice 29A relative to the open axial end.

In the meaning of the present invention, a sealing axial bearing surface is a cylindrical surface of constant radius, extending axially, and that can co-operate in sealed manner with the corresponding surface situated facing it via a sealing gasket. In the meaning of the present invention, a sealing inside bearing surface arrangement is an arrangement that comprises at least one sealing inside axial surface.

It can be seen that the first sealing inside bearing surface arrangement comprises two axial bearing surfaces, respectively 30A and 30B, which are staggered relative to each other, by being separated by a shoulder 30C that faces towards the open axial end. Similarly, the second sealing inside bearing surface arrangement comprises a first axial bearing surface 32A and a second axial bearing surface 32B that are staggered relative to each other, by being separated by a shoulder 32C that also faces towards the open axial end 11A. Conversely, the third sealing inside bearing surface arrangement comprises two sealing axial surfaces, respectively 34A and 34B, that are situated at the same radius.

It can be seen that the bearing surface 30A of the first arrangement 30 is provided with an annular groove 30D in which a sealing gasket 30' is disposed, in the same way as the first axial bearing surface 32A of the second arrangement 32 is provided with an annular groove 32D in which a gasket 32' is disposed. In addition, in the example shown, the axial bearing surface 34B of the third arrangement 34 is also provided with an annular groove 34C, in which a gasket 34' is disposed.

It can also be observed in FIGS. 1 and 1A that the casing portion 10A is provided with a secondary hole 31 that opens out into the inside axial face 11B of this casing portion via a secondary orifice 31A situated beyond the second main orifice 29A in the direction going away from the open axial end 11A. The two axial bearing surfaces 34A and 34B of the third inside bearing surface arrangement 34 are situated on either side of this secondary opening 31A. However, in the example shown in FIG. 1, using the internal distributor 15 that is shown, this secondary hole is unused, and, in this example, is closed off by a stopper 31B. It is also possible to form the casing 10A without the secondary hole 31, and merely to machine that hole (since its geometrical shape is particularly simple) whenever necessary, as explained below with reference to FIGS. 2 and 3.

In the example shown in FIG. 1, the internal distributor 15 is simple, and it is also particularly light in weight, since it is provided with a through central bore 15'. Its outside axial face 15B has three sealing outside bearing surface arrangements. These are constituted by a first arrangement 40 situated between the distribution face 15A and the first groove 17, by a second arrangement 42 situated between the grooves 17 and 19, and by a third arrangement 44 situated beyond the groove 19 relative to the distribution face 15A. In this example, each of the sealing outside bearing surface arrangements 40, 42, and 44 comprises a single axial bearing surface. These axial bearing surfaces co-operate simply with the above-mentioned sealing gaskets 30', 32', and 34' to establish sealed contact between the face 11B of the casing 10A and the face 15B of the distributor, at a plurality of places, namely: between the distribution face 11A and the first groove 17, between the two grooves 17 and 19, and beyond the second groove 19. In other words, this co-operation separates the two grooves 17 and 19 from each other so that fluid cannot flow from one to the other, and also separates them from the environment.

The distribution assembly shown in FIGS. 1 and 1A and comprising the casing portion 10A and the internal distribution portion 15 is particularly simple, used for a single operating cylinder capacity, the internal distributor not having any cylinder capacity selector. For the purpose of initially putting the distribution face of the distributor 15 into contact with the communication face of the cylinder block, one or more springs 36 are disposed between the end wall 11C of the casing portion 10A and the axial end of the internal distributor that is opposite from its distribution face 15A.

The sealing gaskets 30', 32' and 34' are arranged in the grooves 30D, 32D and 34C, respectively, and are disposed in these grooves before inserting the internal distributor 15 into the casing by an axial movement along arrow S of FIG. 1A. The outside axial face 15B of the internal distributor 15 has chamfered portions 30", 32" and 34" which respectively cooperate with the sealing gaskets 30', 32' and 34' upon insertion of the internal distributor into the casing. Such chamfered portions, which could likewise be rounded portions or similar, thus contribute to holding the sealing gaskets in their respective grooves when the internal distributor is mounted into the casing.

Figure 2:
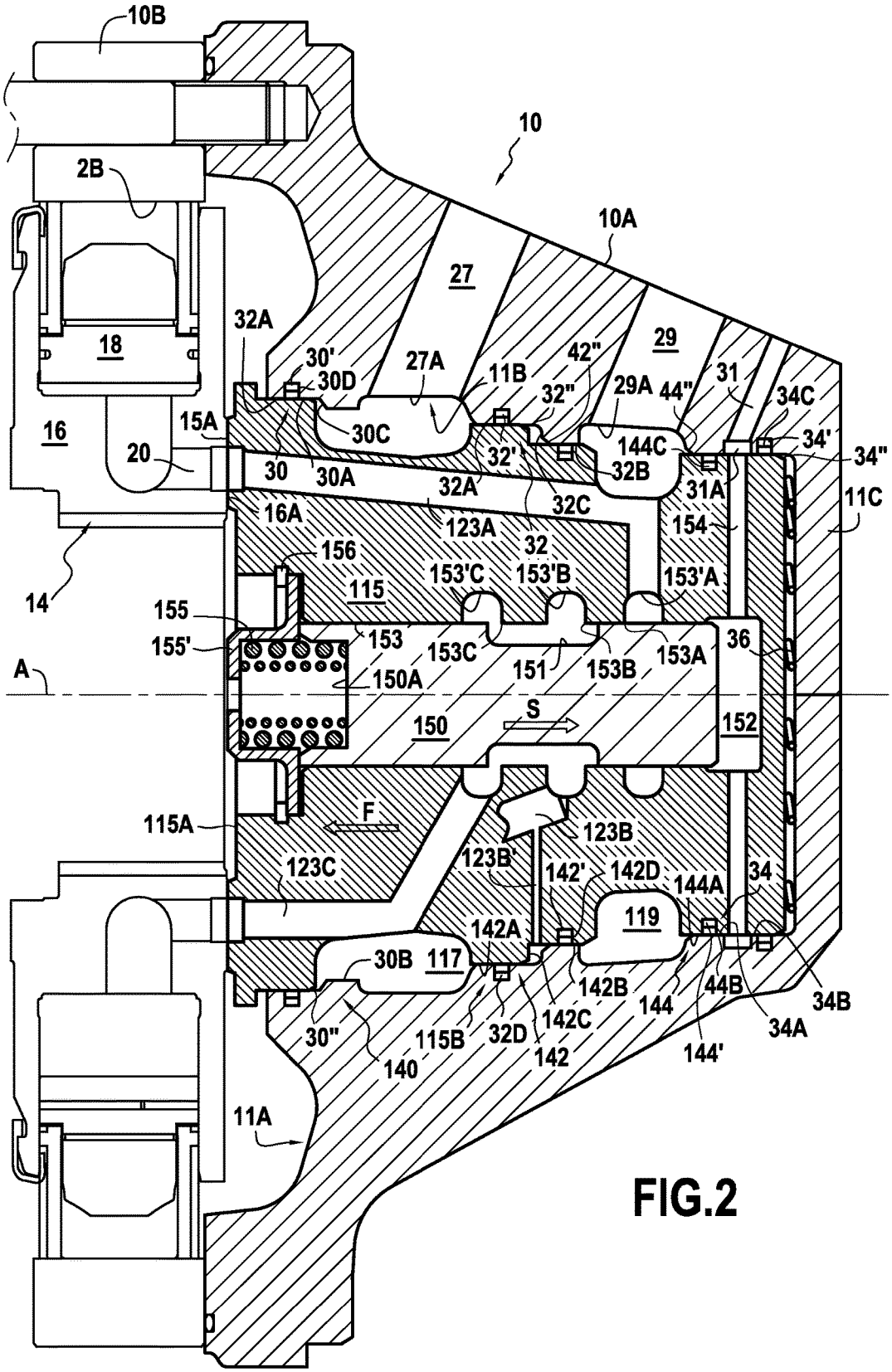
FIG. 2 shows the distribution casing device of the invention, receiving an internal distributor of a second type.

A description follows of FIG. 2 in which the casing portion 10A is identical to the casing portion of FIG. 1. However, the internal distributor 115 is different from the internal distributor 15. Naturally, it has similarities with the internal distributor 15, and in particular two main grooves 117 and 119 that are situated in its outside axial face 115B, and, respectively face the first main orifice 27A and the second main orifice 29A of the casing portion 10A. In addition, it has a radial distribution face 115A thrust against the communication face 16A of the cylinder block. This internal distributor 115 is provided with distribution ducts that open out in the distribution face 115A and that are configured to be connected to one or the other of the main grooves 117 and 119. In addition, the outside axial face 115B of the internal distributor 115 has three sealing outside bearing surface arrangements, respectively 140, 142, and 144, which are respectively suitable for co-operating with the first, second, and third sealing inside bearing surface arrangements 30, 32, and 34 of the casing portion 10A.

At least one of the sealing outside bearing surface arrangements of the internal distributor, in this example the arrangement 142, is a staggered outside arrangement that is suitable for co-operating with one of staggered inside arrangements, in this example the arrangement 32. It can be seen that this arrangement 142 has two axial bearing surfaces, respectively 142A and 142B that are staggered relative to each other by being separated by a shoulder 142C that faces in the direction opposite from the direction in which the distribution face 115A faces. In other words, this shoulder 142C faces the shoulder 32C of the sealing inside bearing surface arrangement 32. The axial bearing surface 142A of the arrangement 142 co-operates with the axial bearing surface 32A of the arrangement 32 via the sealing gasket 32'. Similarly, the axial bearing surface 142B co-operates with the axial bearing surface 32B of the arrangement 32 via a sealing gasket. In this example, this gasket 142' is disposed in a groove 142D provided in the axial surface 142B. Thus, the space situated between the facing shoulders 32C and 142C is sealed on either side axially.

Conversely, the sealing outside bearing surface arrangement 140 has an axial bearing surface with a single axial surface that co-operates with the surface 30A of the arrangement 30, via the gasket 30'. The sealing outside bearing surface arrangement 144 has a single axial bearing surface, with two axial surfaces 144A and 144B that co-operate with respective ones of the axial surfaces 34A and 34B, respectively via the gasket 34' and via a gasket 144' situated in a groove 144C in the axial surface 144A.

Unlike in the example shown in FIG. 1, the secondary hole 31 in the casing portion 10A is not closed off. It serves to control a cylinder capacity selection slide 150 disposed in the internal distributor 115. For that purpose, the end of the internal distributor 115 that is opposite from its distribution face 115A has a control chamber 152 that is connected to the secondary orifice 31A via a hole 154 in the internal distributor 115. In this example, this hole 154 is arranged radially and communicates with the annular groove in the inside axial face of the casing portion 10A in which the secondary orifice 31A is situated. In this example, the control chamber 152 is formed at the end of an internal central bore 153 of the distributor 115. This bore extends axially and the chamber 152 is disposed at the end of said bore that is opposite from the distribution face 115A. The internal distributor 115 may be formed in one piece and, to make it simpler to manufacture, the duct 154 may be a radial hole passing through it from one side to the other.

The axial bore 153 has first, second, and third selection orifices, respectively 153A, 153B, and 153C, which three orifices are disposed in axial succession. In this example, these orifices are situated in grooves in the bore, respectively grooves 153'A, 153'B, and 153'C. Each of these orifices 153A, 153B, and 153C is connected to a respective group of distribution ducts. FIG. 2 shows one duct of each of these groups, namely a duct 123A that communicates permanently with the orifice 153A, a duct 123B that communicates permanently with the orifice 153B, and a duct 123C that communicates permanently with the orifice 153C. The orifice 153A is connected permanently to the main groove 119, so that the distribution ducts of the first group 123A communicate permanently with said groove and thus with the main hole 29. Similarly, the orifice 153C communicates with the main groove 117, so that the distribution ducts of the third group 123C communicate permanently with the main orifice 27. Conversely, the orifice 153B is connected to the staggered outside arrangement 142. It can be seen that the orifice 153B is connected to the space provided between the respective shoulders 32C and 142C of the arrangements 32 and 142, via a segment of radial duct 123B' (there may be a plurality of such segments) itself connected to a distribution duct of the second group 123B. Thus, the pressure of fluid flowing through the distribution ducts of the second group thrusts against the shoulder 32C to act on the shoulder 142C and to tend to push the distributor 115 back towards the communication face of the cylinder block, in the direction indicated by arrow F.

When the slide 150 is in the position shown in FIG. 2, the "selection" outside annular groove 151 with which said slide is provided puts the orifices 153B and 153C into communication. Therefore, the distribution ducts of the second group 123B are brought to the same pressure as the distribution ducts of the third group 123C. This is the second position of the slide, in which the second and third selection orifices 153B and 153C are interconnected without being connected to the first selection orifice 153A.

When the slide is in the first position (not shown), said slide is moved in the direction indicated by arrow S relative to what is shown in FIG. 2, so that the groove 151 puts the first and second selection orifices 153A and 153B into communication with each other and those orifices are then no longer connected to the third selection orifice 153C.

For example, in the normal operating situation, the main orifice 29 serves as the fluid feed, while the main orifice 27 serves as the fluid discharge. The number of distribution ducts of the third group is equal to the sum of the number of ducts of the first and second groups. When the slide 150 is in its first position, all of the distribution ducts of the first and second groups 123A and 123B serve as feeds, while the distribution ducts of the third group 123C serve as discharges. The motor then operates in full cylinder capacity mode. Conversely, when the slide 150 is in the second position shown in FIG. 2, only the distribution ducts of the first group 123A serve as feeds, while the distribution ducts of the second and third groups 123B and 123C serve as discharges. Thus, the sub-motor corresponding to the distribution ducts of the second group 123B and to the sub-group of the distribution ducts of the third group 123C that are associated with it is inactive, its distribution ducts being placed at the same pressure. As indicated above, by means of the hole 153B communicating with the space provided between the shoulders 32C and 142C, the distributor is balanced.

In the non-preferred operating mode, the main hole 29 serves as the discharge, while the main hole 27 serves as the feed. In this situation, when the selection slide 150 is in the second position shown in FIG. 2, the distribution ducts of the second and third groups are placed at the same pressure, which is then the feed pressure. The inactivated sub-motor is then subjected to the feed pressure, so that said inactivated sub-motor can deliver resistive torque. This small cylinder capacity operating direction is then non-preferred.

It is the fluid pressure in the control chamber 152 that makes it possible to move the selection slide 150 towards its second position shown in FIG. 2. This pressure opposes the return force exerted by a spring 155 disposed at the opposite end of the selection slide 150. This spring thrusts firstly against the end 150A of the selection slide that is opposite from the control chamber 152, and secondly against a dish 155' that is secured to the body of the internal distributor 115, e.g. by means of a circlip 156 or the like.

The body of the internal distributor 115 can be manufactured in one piece and, to finish off said distributor, it suffices to dispose the selection slide 150 in the bore 153, to put the spring 155 in place, and to fasten the dish 155'. The internal distributor 115 equipped with the selection slide can then be handled as a unit.

In the example shown, only the axial end of the bore 153 that is situated on the same side as the open axial end 11A of the casing portion 10 is open, the opposite axial end being closed by a wall formed integrally with the body of the distributor 115. Naturally, this wall could be separate and fastened by any suitable means to the body of the distributor.

Like the assembly shown in FIGS. 1 and 1A, the assembly of FIG. 2 includes a spring 36 that co-operates with the casing portion 10A and with the internal distributor to move said internal distributor away from the end wall of the casing portion 10A that is opposite from its open end. This makes it possible to initiate thrust of the distribution face against the communication face, this thrust being reinforced when the pressure increases while the motor is operating, by the fluid thrust resulting from the pressure of fluid in the grooves 119 and 117. At the same time, the fluid pressure between the shoulders 32C and 142C contributes to this fluid thrust with an appropriate force, balancing the opposing thrust resulting from the pressure of the fluid at the distribution orifices against the uninterrupted portions of the communication face. Thus, regardless of whether the motor is operating in large cylinder capacity mode or in small cylinder capacity mode, the distribution face of the distributor is pressed correctly against the communication face of the cylinder, with the suitable balancing.

Figure 3:
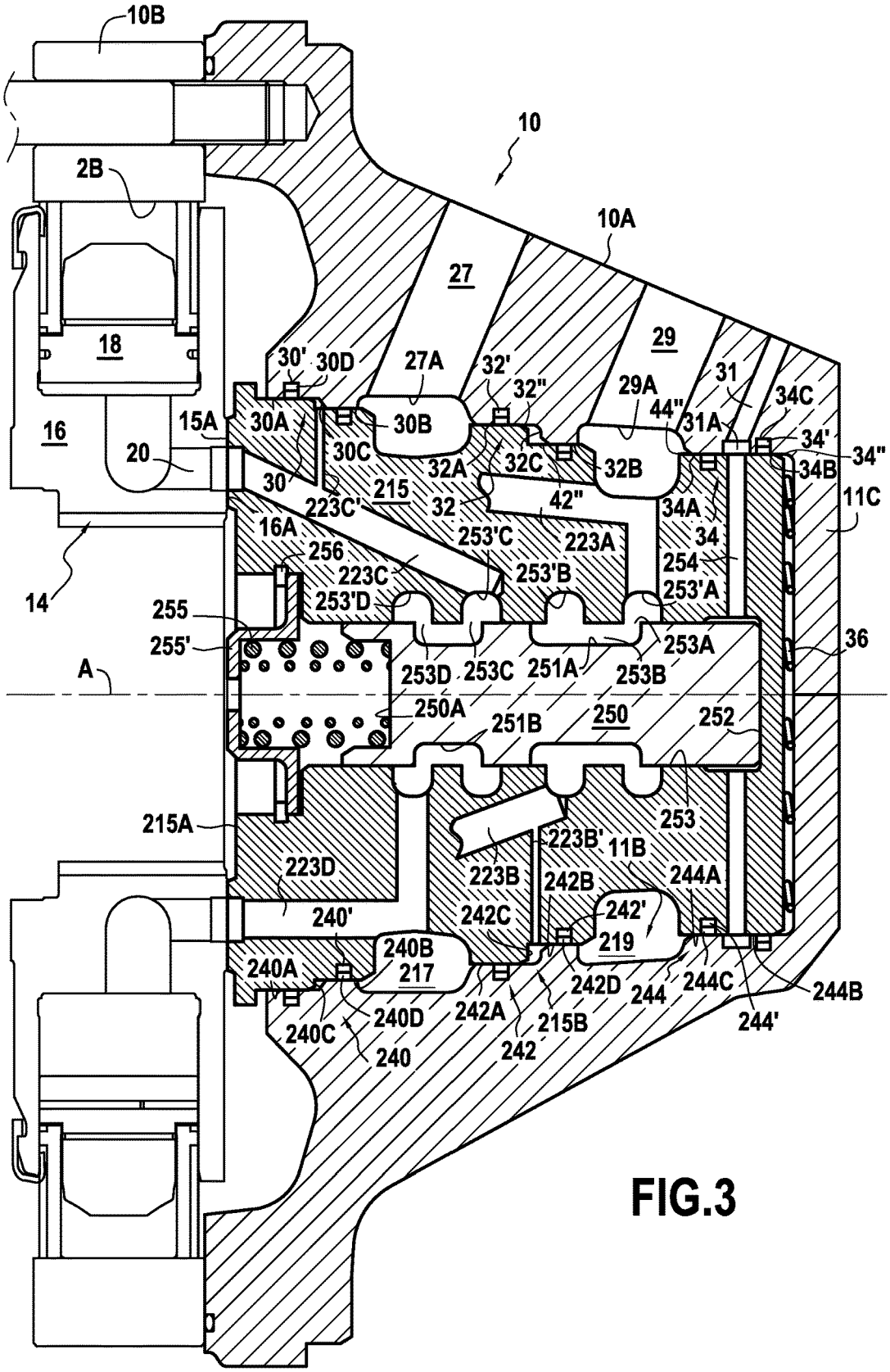
FIG. 3 is a view analogous to FIG. 2, with an internal distributor of a third type, in a large cylinder capacity configuration.
Figure 4:
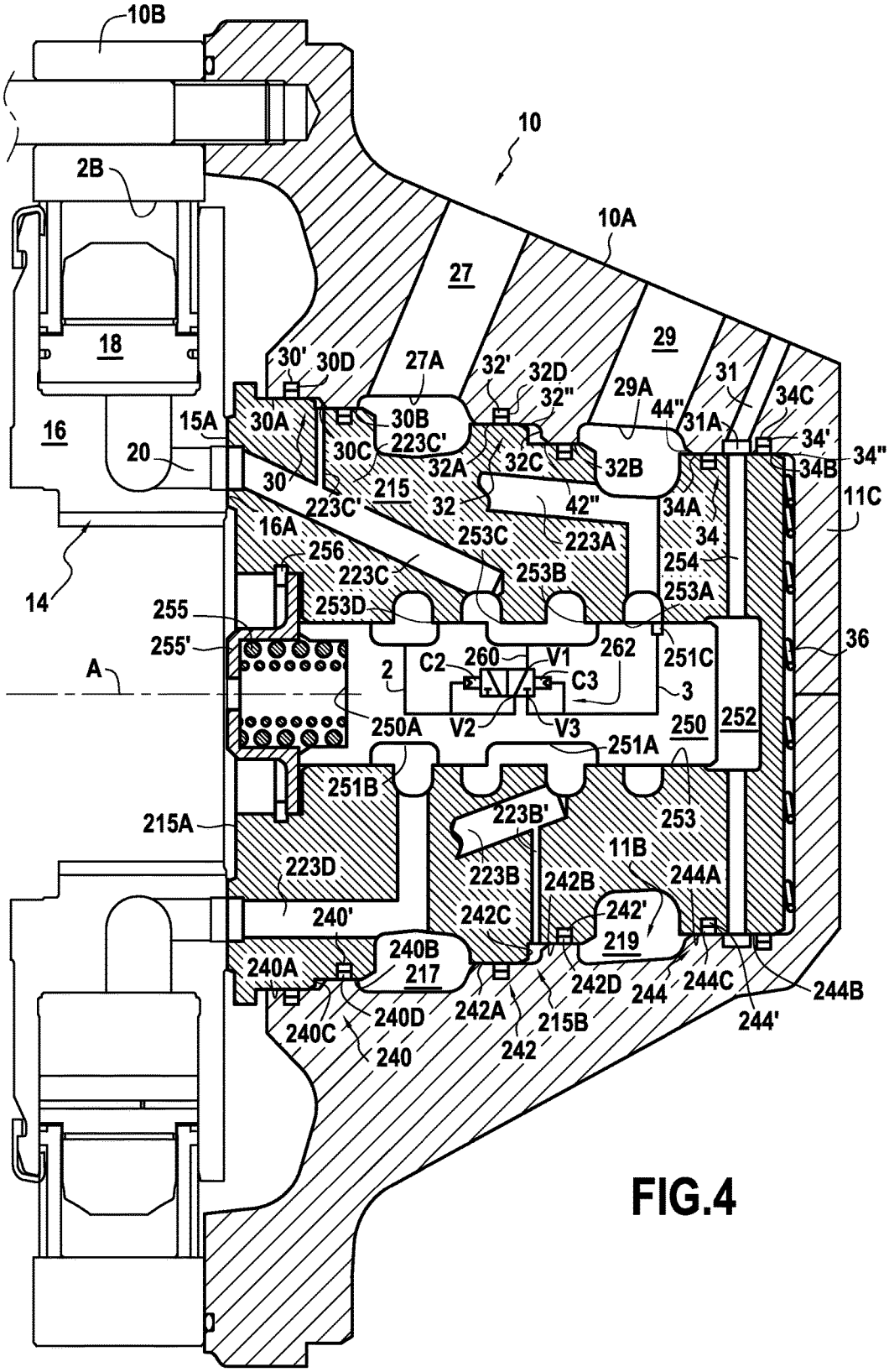
FIG. 4 is a view analogous to FIG. 3, showing the small cylinder capacity configuration.

A description follows of FIGS. 3 and 4, which show the use of the device of the invention for a motor having two active operating cylinder capacities. However, unlike the motor of FIG. 2, this motor does not have a preferred operating direction.

In these figures, the internal distributor 215 is disposed in the casing portion 10A that is identical to the casing portion of FIGS. 1 and 2. The radial distribution face 215A of this distributor is situated in the vicinity of the open axial end 11A of the casing portion 10A and thrusts against the communication face 16A of the cylinder block. The outside axial face 215B of the distributor faces the inside axial face 11B of the casing portion 10A. This outside axial face 215B has two main grooves, respectively 217 and 219, facing respective ones of the first and second main orifices 27 and 29. It also has three sealing outside bearing surface arrangements, respectively 240, 242, and 244.

These sealing outside bearing surface arrangements are respectively suitable for co-operating with the first, second, and third sealing inside bearing surface arrangements 30, 32, and 34 of the casing portion 10A. This internal distributor 215 is provided with distribution ducts that open out in the distribution face 215A and that are configured to be connected to one or the other of the main grooves 217 and 219 via a selection slide 250 mounted to move in an axial bore 253 of the distributor. Before describing the slide in more detail, it should be noted that the two sealing outside bearing surface arrangements 240 and 242 are staggered arrangements. Each of them has two axial bearing surfaces, respectively 240A & 240B and 242A & 242B, the two bearing surfaces of each them being staggered relative to each other by being separated by a respective shoulder 240C, 242C that faces in the direction opposite from the direction in which the distribution face 215A faces. The sealing outside bearing surface arrangements 240 and 242 that are staggered co-operate with respective ones of the staggered sealing inside bearing surface arrangements 30 and 32. The shoulders 240C and 242C are situated facing respective ones of the shoulders 30C and 32C. Conversely, the third sealing inside bearing surface arrangement 244 comprises two sealing axial surfaces, respectively 244A and 244B, that are situated at the same radius. The two axial surfaces co-operate with respective ones of the two axial surfaces 34A and 34B of the third sealing outside bearing surface.

In addition, in its axial surface 240B, the arrangement 240 has a groove 240D in which a sealing gasket 240' is situated, and, similarly, the axial surface 242B has a groove 242D in which a gasket 242' is situated. Thus, the spaces situated between the shoulders 240C and 30C are sealed on either side by the gaskets 30' and 240', and, similarly, the space situated between the shoulders 242C and 32C is sealed on either side by the gaskets 32' and 242'. The axial surface 244A has a groove 244C in which a sealing gasket 244' is situated. Thus, the orifice 31A of the secondary hole 31, which communicates with a hole 254 in the distributor 215, is sealed on either side by the gaskets 244' and 34'. The secondary hole thus serves to feed the control chamber 252 of the cylinder capacity selector, which chamber is situated at that end of the selection slide 250 that is opposite from the distribution face 215A.

The internal central axial bore 253 of the distributor 215 has four selection orifices, respectively 253A, 253B, 253C, and 253D, which are disposed in succession axially. These orifices open out into annular grooves, respectively 253'A, 253'B, 253'C and 253'D. Each of the selection orifices is connected to a group of distribution ducts. FIG. 3 thus shows a distribution duct 223A of the first group connected to the orifice 253A, a distribution duct 223B of the second group connected to the orifice 253B, a distribution duct 223C of the third group connected to the orifice 253C, and a distribution duct 223D of the fourth group connected to the orifice 253D. The selection orifice 253B is connected to the staggered outside arrangement 242 via a duct segment 223B' that extends between the duct 223B and the space between the shoulders 32C and 242C. Similarly, the selection orifice 253C is connected to the staggered outside arrangement 240 via a duct segment 223C' that extends between the duct 223C and the space between the shoulders 30C and 240C.

In FIG. 3, the slide 250 occupies its first position, in which the selection orifices are interconnected in pairs. The orifices 253A and 253B are interconnected while being isolated from the other two, while the orifices 253C and 253D are interconnected while being isolated from the other two. The selection orifice 253A is also connected permanently to the groove 219 and thus to the main orifice 29, and similarly the selection orifice 253D is connected permanently to the groove 217 and thus to the main orifice 27. Therefore, in the first position shown in FIG. 3, the distribution ducts of the first and second groups 223A, 223B are all connected to the main orifice 29, while the distribution ducts of the third and fourth groups, 223C and 223D, are all connected to the main orifice 27. More precisely, the selection slide 250 has two selection grooves, respectively 251A and 251B, which, when the slide is in the first position as shown in FIG. 3, respectively interconnect the selection orifices 253A and 253B, and the selection orifices 253C and 253D. The operating mode is then the large cylinder capacity mode, the rotor of the motor rotating in one direction or in the opposite direction depending on whether the main orifices 27 and 29 serve respectively as feed or as discharge, or vice versa.

It should be noted that the two selection orifices 253B and 253D that are connected to respective ones of the staggered arrangements 240 and 242 are not interconnected via the selection slide 250 when said slide is in the first position as shown in FIG. 3.

Conversely, when the slide 250 is in the second position as shown in FIG. 4, the groove 251A interconnects the second and third selection orifices 253B and 253C. In this situation, the selection groove 251B is disposed facing the third selection orifice 253D only. The selection slide 250 is caused to go from its first position to its second position by feeding the control chamber 252 with fluid, via the secondary hole 31 and via the hole 254 in the distributor 215. This fluid pressure opposes the return force exerted by a spring 255 disposed at the opposite end of the selection slide 250. As in the example in FIG. 2, this spring thrusts at one end against the end 250A of the slide 250 that is opposite from the chamber 252 and at the other end against a dish 255' fastened to the body of the distributor 215 via a circlip or the like 256.

The selection slide includes a link 260 that, in its second position as shown in FIG. 4, interconnects the two selection orifices 253B and 253C, and a selector 262 that, when the slide 250 is in the second position, connects said link 260 to that one of the other two selection orifices 253A and 253D that is at the lower pressure. To simplify the drawings, only the link 260 and the selector 262 are shown in FIG. 4. This selector is shown highly diagrammatically. It is a two-position, three-port valve, its outlet port V1 being connected to the link 260 that is itself connected to the selection groove 251A in such a manner as to be connected to the orifices 253B and 253C when the slide 250 is in its second position. The selector 262 has two inlet ports, respectively V2 and V3. In the example shown in FIG. 4, the port V2 is connected to the groove 251B in such a manner as to be connected to the selection orifice 253D when the slide 250 is in the second position. The second inlet port V3 of the selector 262 is connected to an additional groove 251C of the slide 250 that, in the position shown in FIG. 4, is in register with the orifice 253A. The ducts 2 and 3, which connect respective ones of the ports V2 and V3 to the grooves 251B and 251C, are also connected to respective control chambers C2 and C3. In the example shown, the pressure in the hole 29 that serves as the feed is greater than the pressure in the hole 27 that serves as the discharge. Therefore, the pressure in the control chamber C3 is greater than the pressure in the control chamber C2, and the selector is placed in the position shown in FIG. 4, in which position, it puts the ports V2 and V1 into communication with each other, while isolating them from the port V3. Thus, the link 260 is connected to the main orifice 27 that is at the lower pressure. It can be understood that, if the pressure in the main orifice 27 becomes greater than the pressure in the main orifice 29, the selector moves to its second position, in which it puts the ports V1 and V3 into communication with each other, so as place the link 260 at the low pressure of orifice 29.

In the situation shown in FIG. 4, only the selection orifice 253A is connected to the high pressure of the main orifice 29, so that only the distribution ducts of the first group 223A are put at the high pressure. Conversely, the distribution ducts of the second and third groups, respectively 223B and 223C are connected to the distribution ducts of the fourth group 223D via the link 260 and the selector 262, and are thus put at the low pressure of the main orifice 27. Thus, the distribution ducts of the second and third groups 223B and 223C are placed at the same pressure, which is the discharge pressure, and the corresponding sub-motor is deactivated. It can be understood that the pressure reverses at the main orifices 27 and 29, and it is then the orifice 29 that serves as the discharge, and, via the selector 262, the link 260 is then connected to the low pressure of the orifice 29, and the deactivated sub-motor, corresponding to the distribution ducts 223B and 223C, is also put at the low pressure.

In FIGS. 3 and 4, as in the preceding figures, the spring 36 co-operates with that end of the distributor 215 that is opposite from the distribution face 215A so as to achieve first thrust of the distribution face against the communication face. Under the effect of the fluid pressure in the distribution ducts, this first thrust is supplemented by hydraulic thrust, achieved by the fluid pressure exerted on the walls of the grooves 217 and 219, and also on the shoulders 242C and 240C facing the shoulders 32C and 30C. Thus, even when the sub-motor corresponding to the distribution ducts of the second and third groups is deactivated, the hydraulic thrust is balanced.

Naturally, the surface areas of the shoulders and of the grooves subjected to the hydraulic fluid pressure for achieving the hydraulic thrust are dimensioned as a function of the thrust that is to be obtained.

By means of the invention, with the same distribution casing portion 10A, a motor is obtained that can have a single cylinder capacity, or indeed two cylinder capacities, in two variants having either one preferred operating direction, or no preferred operating direction. When said casing portion is used with an internal distributor making it possible to obtain two cylinder capacities, and including a selection slide 150 or 250, said slide can be mounted in the internal distributor body by being fastened in said body by means of the dish 155' or 255', so that the resulting assembly can be handled as a single unit and placed in the casing portion.

The wall of the internal distributor 215 that is opposite from the distribution face may be formed integrally as a one-piece unit with the body of said distributor, or else it may be separate and mounted on it, as applies for the internal distributor 115.

As in the first embodiment show in FIG. 1A, the outside faces 115B and 215B of the internal distributors 115 and 215 in FIGS. 2 to 4 have chamfered portions or similar, respectively, 30", 32" and 34", for respectively cooperating with the sealing gaskets 30', 32' and 34' upon insertion of the internal distributor into the casing.

Similarly, the inside axial face 11B of the casing portion 10A has chamfered portions or similar (for example rounded portions), respectively 42" and 44", for respectively cooperating with the sealing gaskets 142' (or 242') and 144' (or 244') of the embodiments of FIGS. 2 to 4 and for holding said sealing gaskets in place in their respective grooves, respectively 142D (or 242D) and 144C (or 244C) upon insertion of the distributor into the casing portion.

The invention claimed is:

1. A distribution casing device for a hydraulic machine, said distribution casing device comprising: a casing portion that has an open axial end and that has two main holes, respectively for fluid feed and for fluid discharge, said holes opening out in an inside axial face of the casing portion, respectively via a first main orifice and via a second main orifice, which orifices are disposed in succession in the direction going axially away from the open axial end, the inside axial face having first, second, and third sealing inside bearing surface arrangements, respectively situated between the open axial end and the first main orifice, between the two main orifices, and beyond the second main orifice relative to the open axial end, the first and second sealing inside bearing surface arrangements being staggered inside arrangements, each of which comprises two axial bearing surfaces that are staggered relative to each other, and that are separated by a shoulder facing towards the open axial end, wherein for each of the first and second sealing inside bearing surface arrangements, only one of the axial bearing surfaces presents an annular groove suitable for receiving a sealing gasket.

2. The device according to claim 1, wherein the casing portion is provided with a secondary hole that opens out in the inside axial face via a secondary orifice situated beyond the second main orifice relative to the open axial end, and the third sealing inside bearing surface arrangement has two axial bearing surfaces situated at a same diameter on either side of the secondary orifice.

3. The device according to claim 2, wherein at least one of the axial bearing surfaces of the third sealing inside bearing surface arrangement has an annular groove, suitable for receiving a sealing gasket.

4. A distribution assembly for a hydraulic machine, comprising: a casing device and an internal distributor, said distribution casing device comprising a casing portion that has an open axial end and that has two main holes, respectively for fluid feed and for fluid discharge, said holes opening out in an inside axial face of the casing portion, respectively via a first main orifice and via a second main orifice, which orifices are disposed in succession in the direction going axially away from the open axial end, the inside axial face having first, second, and third sealing inside bearing surface arrangements, respectively situated between the open axial end and the first main orifice, between the two main orifices, and beyond the second main orifice relative to the open axial end, the first and second sealing inside bearing surface arrangements being staggered inside arrangements, each of which comprises two axial bearing surfaces that are staggered relative to each other, and that are separated by a shoulder facing towards the open axial end, wherein for each of the first and second sealing inside bearing surface arrangements, only one of the axial bearing surfaces presents an annular groove suitable for receiving a sealing gasket, the internal distributor being arranged in the casing portion in such a manner that a radial distribution face of said internal distributor being situated in the vicinity of the open axial end of the casing portion in such a manner that an outside axial face of the internal distributor faces the inside axial face of the casing portion, said outside axial face having first and second main grooves facing respective ones of the first and second main orifices, and first, second, and third sealing outside bearing surface arrangements, suitable for co-operating with respective ones of the first, second, and third sealing inside bearing surfaces, the internal distributor having distribution ducts that open out in the radial distribution face and that are configured to be connected to one or the other of the main grooves.

5. The assembly according to claim 4, including at least one spring cooperating with the casing device and with the internal distributor to move said internal distributor away from that end wall of the casing portion that is opposite from said open axial end.

6. The assembly according to claim 4, wherein the first and second sealing inside bearing surface arrangements are staggered inside arrangements.

7. The assembly according to claim 4, wherein each sealing outside bearing surface arrangement comprises a single axial bearing surface.

8. The assembly according to claim 4, wherein at least one of the axial bearing surfaces of each staggered inside arrangement has an annular groove, suitable for receiving a sealing gasket.

9. The assembly according to claim 4, wherein the casing portion is provided with a secondary hole that opens out in the inside axial face via a secondary orifice situated beyond the second main orifice relative to the open axial end, and the third sealing inside bearing surface arrangement has two axial bearing surfaces situated at a same diameter on either side of the secondary orifice.

10. The assembly according to claim 4, wherein the internal distributor lacks a cylinder capacity selector and is therefore configured for use with only one operating cylinder capacity, and wherein the outside axial face of the internal distributor lacks grooves for receiving sealing gaskets.

11. The assembly according to claim 4, wherein at least one of the sealing outside bearing surface arrangements is a staggered outside arrangement that is suitable for co-operating with one of the staggered inside arrangements and that comprises two staggered axial bearing surfaces that are staggered relative to each other and that are separated by a shoulder facing in a direction opposite from a direction in which the distribution face faces, the internal distributor having an axial bore having first, second, and third selection orifices that are disposed in axial succession, each one of said selection orifices being connected to a group of distribution ducts, one of the selection orifices being connected to the staggered outside arrangement, and a selection slide being mounted to move in the bore between a position in which the first and second selection orifices are interconnected without being connected to the third selection orifice, and a second position in which the second and third selection orifices are interconnected without being connected to the first selection orifice.

12. The assembly according to claim 11, wherein the selection slide has a single selection groove that, when the slide is in the first position, interconnects the first and second selection orifices and that, when the slide is in the second position, interconnects the second and third selection orifices.

13. The assembly according to claim 11, wherein the casing portion is provided with a secondary hole that opens out in the inside axial face via a secondary orifice situated beyond the second main orifice relative to the open axial end, and the third sealing inside bearing surface arrangement has two axial bearing surfaces situated at a same diameter on either side of the secondary orifice, the secondary orifice being connected to a control chamber of the selection slide.

14. The assembly according to claim 4, wherein at least two of the sealing outside bearing surface arrangements are staggered outside arrangements, each of which is suitable for co-operating with a respective one of the staggered inside arrangements, each staggered outside arrangement comprising two axial bearing surfaces that are staggered relative to each other and that are separated by a shoulder facing in a direction opposite from a direction in which the distribution face faces, the internal distributor having an axial bore that has first, second, third, and fourth selection orifices that are disposed in axial succession, each one of said selection orifices being connected to a respective group of distribution ducts, two selection orifices from among the four selection orifices being connected to respective ones of the two staggered outside arrangements, and a selection slide being mounted to move in the bore between a first position in which the selection orifices are interconnected in pairs and a second position in which three of the selection orifices are interconnected, without being connected to the remaining selection orifice.

15. The assembly according to claim 14, wherein the two selection orifices, which are connected to respective ones of the two staggered outside arrangements, are two selection orifices that are not interconnected via the selection slide, when said slide is in its first position.

16. The assembly according to claim 14, wherein the selection slide includes a link that, when the slide is in the second position, interconnects two selection orifices, and a selector that, when the slide is in said second position, connects said link to that one of the other two selection orifices that is at the lower pressure, the remaining one of said selection orifices thus being the one that is at the higher pressure.

17. The assembly according to claim 14, wherein the selection slide has two selection grooves that, when the slide is in the first position, respectively interconnect the first and second selection orifices, and the third and fourth selection orifices, whereas, when the slide is in the second position, one of said grooves interconnects the second and third selection orifices.

* * * * *